US005918309A

United States Patent [19]

Bachner, Jr.

[11] Patent Number: 5,918,309

[45] Date of Patent: Jul. 6, 1999

[54] BLUNT FORCE RESISTANT STRUCTURE FOR A PROTECTIVE GARMENT

[75] Inventor: Thomas E. Bachner, Jr., Eastport, Mich.

[73] Assignee: Second Chance Body Armor, Inc., Central Lake, Mich.

[21] Appl. No.: 08/949,836

[22] Filed: Oct. 14, 1997

[51] Int. Cl.[6] ..... F41H 1/02

[52] U.S. Cl. ..... 2/2.5; 428/116; 428/911; 89/36.05

[58] Field of Search ..... 2/6.6, 2.5, 455, 2/410; 428/911, 116, 117, 118; 89/36.05, 36.02, 36.01

[56] References Cited

U.S. PATENT DOCUMENTS

| | | | |
|---|---|---|---|
| 2,738,297 | 3/1956 | Pfistershammer . | |
| 3,130,414 | 4/1964 | Bailey et al. . | |
| 3,395,067 | 7/1968 | Lane, Jr. . | |
| 3,447,163 | 6/1969 | Bothwell et al. . | |
| 3,575,786 | 4/1971 | Baker et al. . | |
| 3,582,990 | 6/1971 | Frieder . | |
| 3,862,879 | 1/1975 | Barron et al. . | |
| 3,916,060 | 10/1975 | Fish et al. . | |
| 4,198,454 | 4/1980 | Norton | 428/911 |
| 4,241,131 | 12/1980 | Bailey . | |
| 4,413,357 | 11/1983 | Sacks . | |
| 4,422,183 | 12/1983 | Landi et al. . | |
| 4,472,472 | 9/1984 | Schultz . | |
| 4,483,020 | 11/1984 | Dunn . | |
| 4,510,200 | 4/1985 | Samowich . | |
| 4,566,237 | 1/1986 | Turner . | |
| 4,648,136 | 3/1987 | Higuchi | 2/2.5 |
| 4,739,690 | 4/1988 | Moskowitz . | |
| 4,774,724 | 10/1988 | Sacks . | |
| 5,087,516 | 2/1992 | Groves . | |
| 5,110,661 | 5/1992 | Groves . | |
| 5,200,256 | 4/1993 | Dunbar . | |
| 5,221,807 | 6/1993 | Vives | 89/36.02 |
| 5,317,950 | 6/1994 | Binon et al. | 2/2.5 |
| 5,349,893 | 9/1994 | Dunn | 2/2.5 |
| 5,364,679 | 11/1994 | Groves . | |
| 5,373,582 | 12/1994 | Dragone et al. . | |
| 5,444,881 | 8/1995 | Landi et al. . | |
| 5,471,906 | 12/1995 | Bachner, Jr. et al. | 2/2.5 |
| 5,534,343 | 7/1996 | Landi et al. | 2/2.5 |

*Primary Examiner*—C. D. Crowder
*Assistant Examiner*—Larry D. Worrell, Jr.
*Attorney, Agent, or Firm*—Potthast & Ring

[57] ABSTRACT

A protective garment of multi-component construction for covering and protecting vital portions of a body of a wearer. The protective garment has a layer of body armor material which has at least one of ballistic resistant and puncture resistant capabilities. Additionally, the protective garment includes a flexible sheet formed of a plurality of resilient honeycomb cellular structures which are constructed of thermoplastic polyurethane. The flexible sheet of thermoplastic polyurethane honeycomb structures is positioned to overlie the layer of body armor material and to face outwardly from the body of the wearer. The layer of body armor material is positioned between the flexible sheet of resilient honeycomb cellular structures and the body of the wearer upon which the protective garment is worn.

20 Claims, 5 Drawing Sheets

42
34
40
30
28
32
12
38

BLUNT FORCE RESISTANT STRUCTURE FOR A PROTECTIVE GARMENT

FIELD OF THE INVENTION

The present invention relates to protective garments for resisting an attacking force, and more particularly, to ballistic and/or puncture resistant garments.

BACKGROUND OF THE INVENTION

In the evolution of protective garments, there has been an ever pressing desire to develop stronger, lighter, thinner, more breathable and thereby more wearable garments. Such garments are intended to resist certain potentially lethal forces such as those from gun shots or stabbing types of weapons. Typically, these garments are designed to protect the wearer from ballistic or puncture forces by preventing penetration through the garment from a projectile bullet or sharp object.

However, attacking forces other than gun shots and stabbing type forces are confronted by police officers and correctional officers. For instance a blunt force may be received by an individual upon being struck across the body with blunt objects such as a bat, club, board, hand thrown projectiles and the like. Garments such as baseball type chest protectors and accessories such as riot shields have been used to fend off blunt object attacks. Unfortunately, these often leave the wearer without any appreciable ballistic or stabbing resistant protection. Moreover, certain protector devices often require the anticipation of a blunt force attack and obtainment of a shield which then must be carried by the user thereby disabling the full use of at least one hand of the user.

Attempts have been made in certain ballistic resistant articles to utilize energy absorbing layers constructed of geometric cells. However, such energy absorbing layers are typically rigid and fracturable in attempting to absorb energy from ballistic projectiles received impacting the article. Moreover, such articles typically position the layers to dissipate ballistic energy on the innermost side of the article adjacent the wearer or are fracturable layers which are sandwiched between ballistic resistant materials. Disadvantageously, the construction of these articles has not been shown to effectively protect the wearer against attacks from blunt objects. Therefore, there is a need for a garment which protects the wearer against forces from blunt objects striking against the body while also being ballistic and/or puncture resistant.

SUMMARY OF THE INVENTION

The problems noted above are solved in accordance with the present invention, by a protective garment of multi-component construction having a layer of body armor material to resist projectile penetration and a flexible sheet of thermoplastic polyurethane honeycomb cellular structures. The flexible sheet overlies the body armor material and is positioned at the strike face of the garment relative to the body armor material to also protect the wearer against forces from a blunt object striking the garment.

In accordance with the present invention, a protective garment is formed of a multi-component construction for covering and protecting vital portions of the body of a wearer. The protective garment includes a layer of body armor material which has at least one of ballistic resistant and puncture resistant capabilities. Additionally, the protective garment includes a flexible sheet having a plurality of resilient honeycomb cellular structures constructed of thermoplastic polyurethane positioned to overlie the layer of body armor material and to face outwardly from the body of the wearer and in which the layer of body armor material is positioned between the sheet of resilient honeycomb cellular structures and the body of the wearer upon which the protective garment is worn.

BRIEF DESCRIPTION OF THE DRAWINGS

The foregoing objects and advantageous features of the invention will be explained in greater detail and others will be made apparent from the detailed description of the preferred embodiments of the present invention which is given with reference to the several figures of the drawing, in which.

DETAILED DESCRIPTION

Figure 1:
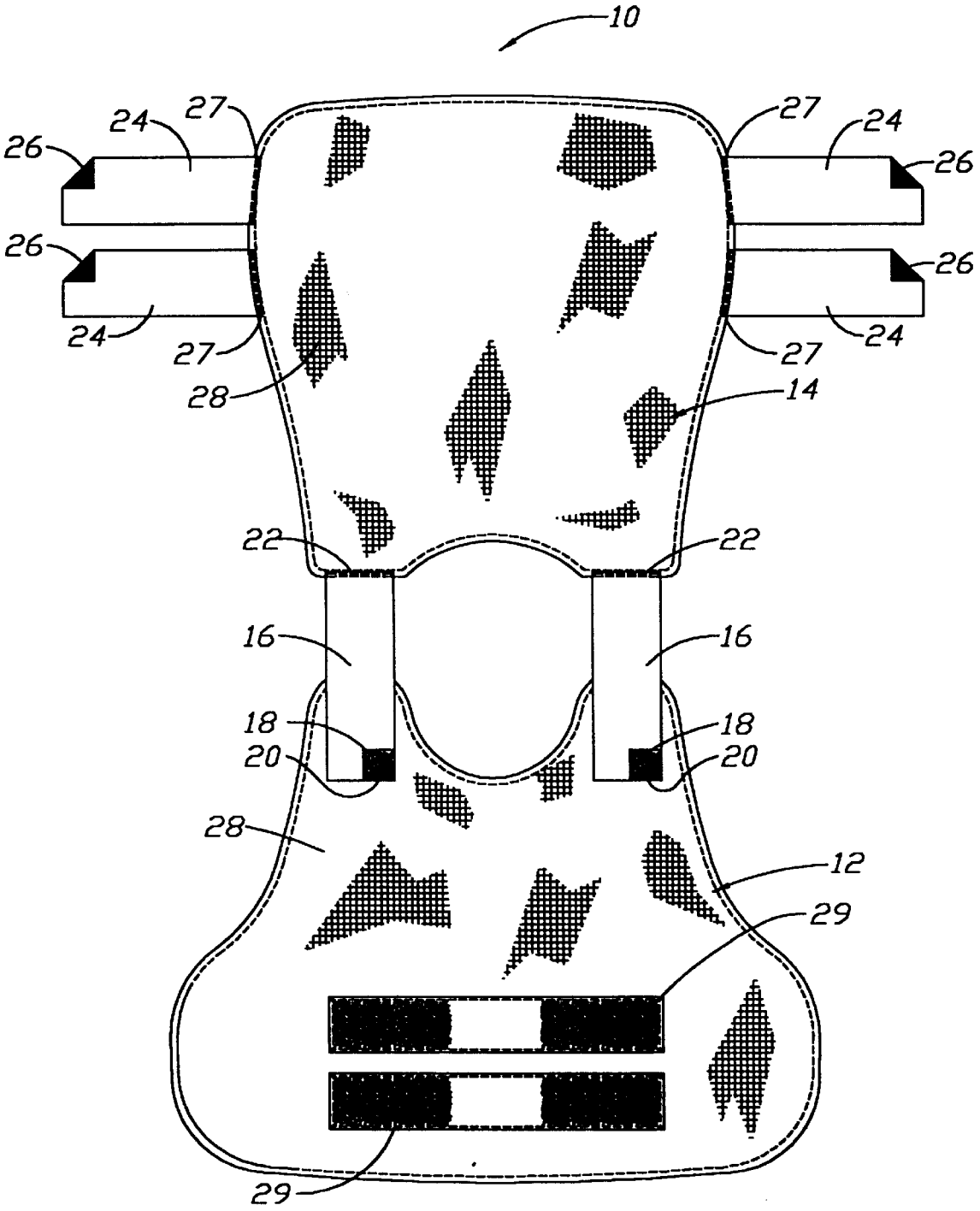
FIG. 1 is a plan view of the protective garment encased within a carrier.

Referring now to FIG. 1 of the drawings, protective garment 10 is shown with front 12 and back 14 panels which are to be worn by a person over the front and back portions of their torso, respectively. Panels 12 and 14 in position overlying the torso region of the wearer, will protect vital portions of the body from undesirable damaging and lethal forces.

Front 12 and back 14 panels are connected together at the shoulder area by shoulder straps 16, having one portion 18 of hook and loop fasteners or Velcro® connecting structure which are releasably secured to their corresponding mating fastener pad members 20. The opposing ends 22 of the shoulder straps 16 are preferably stitched to outer carrier 28 of back panel 14. In use, front panel 12 and back panel 14 are secured together at the sides of the torso of a person wearing protective garment 10 by side straps 24 also shown having Velcro® type connecting fasteners 26 securable to mating fastener pads 29. The other ends 27 of side straps 24 are fixedly secured by stitching or other suitable means to outer carrier 28 of back panel 14. Straps 24 are positioned over one another to a desired fit by the wearer for reliable securement and comfort.

Protective garment 10 is of a multi-component construction which is contained within an outer carrier 28, as seen in FIGS. 2–7B. Carrier 28, as seen in FIG. 1, often takes on the form of a sleeve member which is constructed of woven cloths of polyester or other common clothing materials or the like. The appearance of carrier 28 can facilitate further disguising or camouflaging of protective garment 10, thereby concealing its existence from perpetrators.

The construction of the present invention may selectively include pad cover sleeve 30, for containing layer of body armor material 32, as seen in FIGS. 2–7B. Pad cover 30 is a flexible sleeve preferably constructed of moisture vapor permeable and water proof material. Such cover materials selectively employed are known under their trademark names GORE-TEX®, or Windstopper™, manufactured by W. L. Gore & Associates, Inc. of Newark, Del. This construction provides desired breathability and alleviates the degrading aspects of contaminants such as body oils and salts, fuel spills, soaps, detergents, urine and blood and other undesirable contaminants to internal portions of protective garment 10. The size and shape of pad cover 30 accommodates the enclosing and covering of an inner layer of body armor material 32 which covers the torso region of the wearer. Often the sizing of pad cover 30 is made to provide a close fit to the layer of body armor material 32, particularly, when layer 32 is constructed of multiple layered woven sheets, thereby keeping the layered woven sheets aligned. Alternatively, it is contemplated in the present invention to employ other pad covers, such as those formed of polyester, nylon, woven or rip stop paffeta and like materials.

Body armor layer 32 is contemplated to be constructed to resist penetration of a bullet from gun fire and/or constructed to resist penetration from stabbing attacks with sharp pointed objects such as ice picks, awls, shanks, knives and the like. The multi-component construction of protective garment 10 will not only provide protection from ballistic and/or sharp object attacks but will additionally, protect the wearer from blunt forces with the incorporation of flexible sheet 34 of resilient honeycomb cellular structures constructed of thermoplastic polyurethane, as seen in FIGS. 2–7B. The resilient honeycomb cellular structures are well suited to receive a blunt force and transmit it laterally away from the impact site and thereby distribute its effect over a broader area of the body of the wearer. The flexible sheet 34 composed of honeycomb cells of thermoplastic polyurethane overlies the body armor material 32 and is positioned at the strike face region of the garment 10 relative to the body armor material.

The flexible and resilient sheet 34, FIGS. 4A–7B, having honeycomb structures preferably is an integrally constructed arrangement of open hexagon shaped cells 40 which are fused together about the walls 42 of the cells 40 forming the thermoplastic polyurethane core. In order to provide adequate impact resistance against forces from striking blunt objects, approximately a ¼ (0.25) to 1.0 inch in diameter is a suitable range for the dimension across a single hexagon shaped cell 40. Sidewalls 42 of the hexagonal shaped cells 40 of thermoplastic polyurethane preferably range in height from approximately 0.070 inches to 2.00 inches.

An alternative embodiment arrangement of the flexible sheet 34 of honeycomb structures is seen in FIGS. 5A,5B and 7A,7B. In this arrangement the thermoplastic polyurethane honeycomb core 34 is sandwiched between two polyurethane film sheets 38. The polyurethane film sheets 38 are placed over the top and bottom ends of the flexible honeycomb sheets 34 and are fused together forming an integral structure. The polyurethane film sheets 38 which are disposed over both the top and bottom sides of the flexible honeycomb sheet 34 enclose the top and bottom open ends of the cellular honeycomb structures. Alternatively, a single film outer skin 38 of polyurethane is disposed over either the top side or bottom side of the flexible sheet 34 enclosing one of the open ends (top or bottom) of the cellular structures. The polyurethane film 38 preferably has a thickness ranging from approximately 0.005 inches to 0.020 inches.

The thermoplastic polyurethane honeycomb sheet 34 provides an advantageous structure in the ballistic resistant and/or puncture resistant garment of the present invention in that it is energy absorbing, flexible, impact resistant and light weight. Moreover, the flexible sheet 34 of integrally fused hexagonally shaped open cells is fatigue resistant and resiliently returns to its original shape after impact with a blunt object. Advantageously, by being able to make a complete recovery after impact the flexible sheet positioned proximate the strike face of the garment is enabled to withstand repeated striking blows while continuing to maintain it protective qualities. The thin and light weight qualities of the inventive protective garment enable it to be suitably employed as a concealable item when worn by a user. Preferably, a thermoplastic polyurethane honeycomb sandwich sold by Hexel corporation of Plantation, California under the trademark TPU is suitably used in the protective garment 10. The compressive strength of the TPU™ sandwich structure is approximately 166 pounds per square inch and has a melting point range of 340 to 380 degrees fahrenheit.

Figure 2:
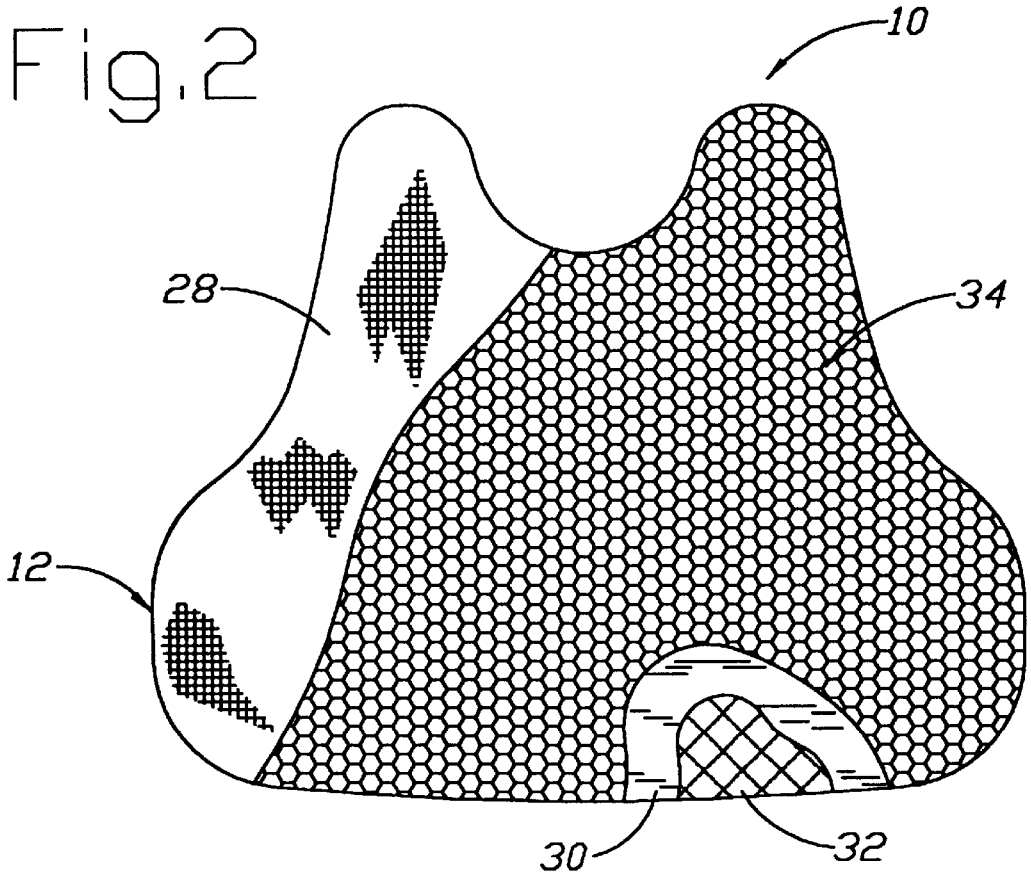
FIG. 2 is a partial broken away plan view of the front of the front panel of the protective garment shown in FIG. 1 with the honeycomb structure positioned over the pad cover that encases a protective layer of body armor material.
Figure 3:
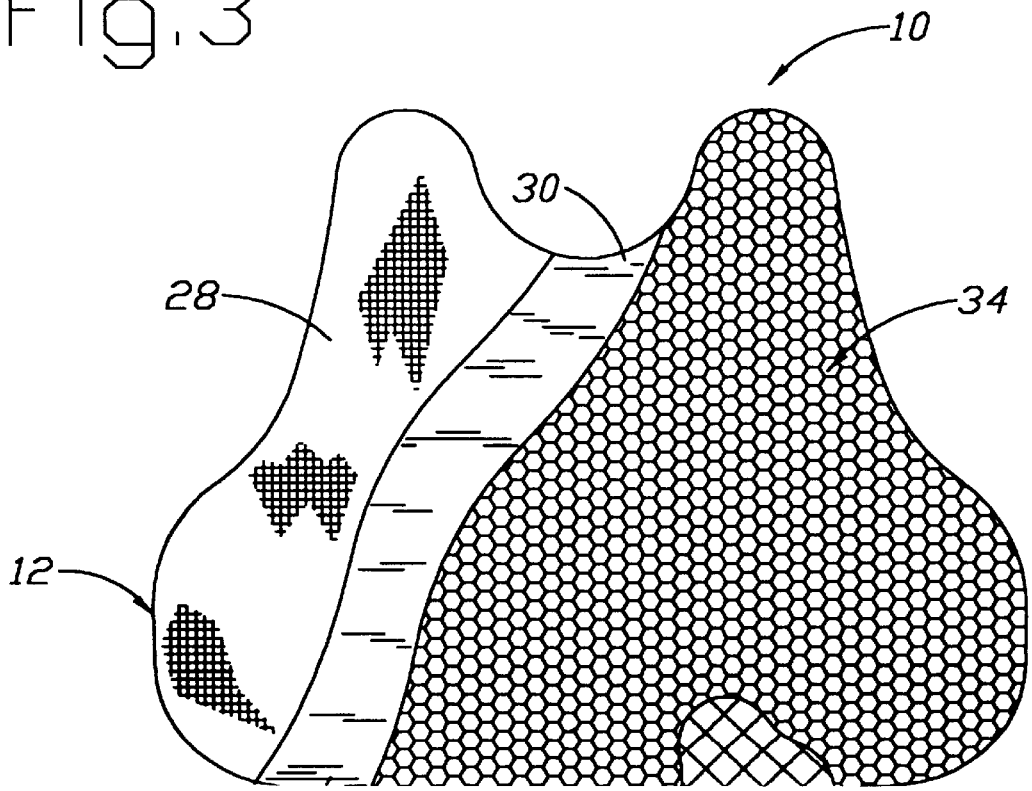
FIG. 3 is a partial broken away plan view of the front of the front panel of the protective garment shown in FIG. 1 with the honeycomb structure positioned within the pad cover that encases a protective layer of body armor material.

As seen in FIGS. 2 and 3, flexible sheet 34 is strategically positioned to substantially coextensively overlie layer of body armor 32 and face outwardly from the body of the wearer. In FIG. 2, flexible sheet 34 overlies pad cover 30 such that pad cover is positioned between flexible sheet 34 and body armor layer 32. In this embodiment, flexible sheet 34 is positioned adjacent to sidewall 36 of pad cover sleeve 30. In this embodiment, the flexible sheet 34, FIG. 2, is secured to the underlying pad cover 30 by the outer carrier 28 which holds the flexible sheet against the pad cover. The outer carrier 28, FIG. 2, confines and encases the flexible sheet 34, pad cover sleeve 30, as well as, the body armor layer 32. Preferably, the flexible sheet 34 and the pad cover 30 surface are coextensive to one another as is the outer carrier 28 which snugly holds and confines the flexible sheet, the pad cover and the body armor material 32. The tight confinement of the carrier 28 enables the substantially coextensively shaped flexible sheet 34 and pad cover 30 to be secured against one another. This securement maintains the flexible sheet 34 in proper alignment for the wearer.

Another embodiment is shown in FIG. 3, in which flexible sheet 34 is positioned between sidewall 36 of pad cover sleeve 30 and the layer of body armor 32. In the embodiment seen in FIG. 3, the flexible sheet 34 is positioned between the pad cover 30 and the body armor layer 32. The flexible sheet 34, FIG. 3, is confined within and is substantially coextensive to the surface of pad cover 30 which provides securement of the flexible sheet against the underlying body armor layer 32 of material. The pad cover sleeve of FIG. 3 is substantially coextensively shaped with the flexible sheet 34 and the body armor layer 32 which it snugly encases and thus, suitably enables securement of the flexible sheet against the body armor layer 32. In both embodiments shown in FIGS. 2 and 3, the layer of body armor material 32 is positioned between the body of the wearer and flexible sheet 34 of protective garment 10.

Figures 4A, 5A:
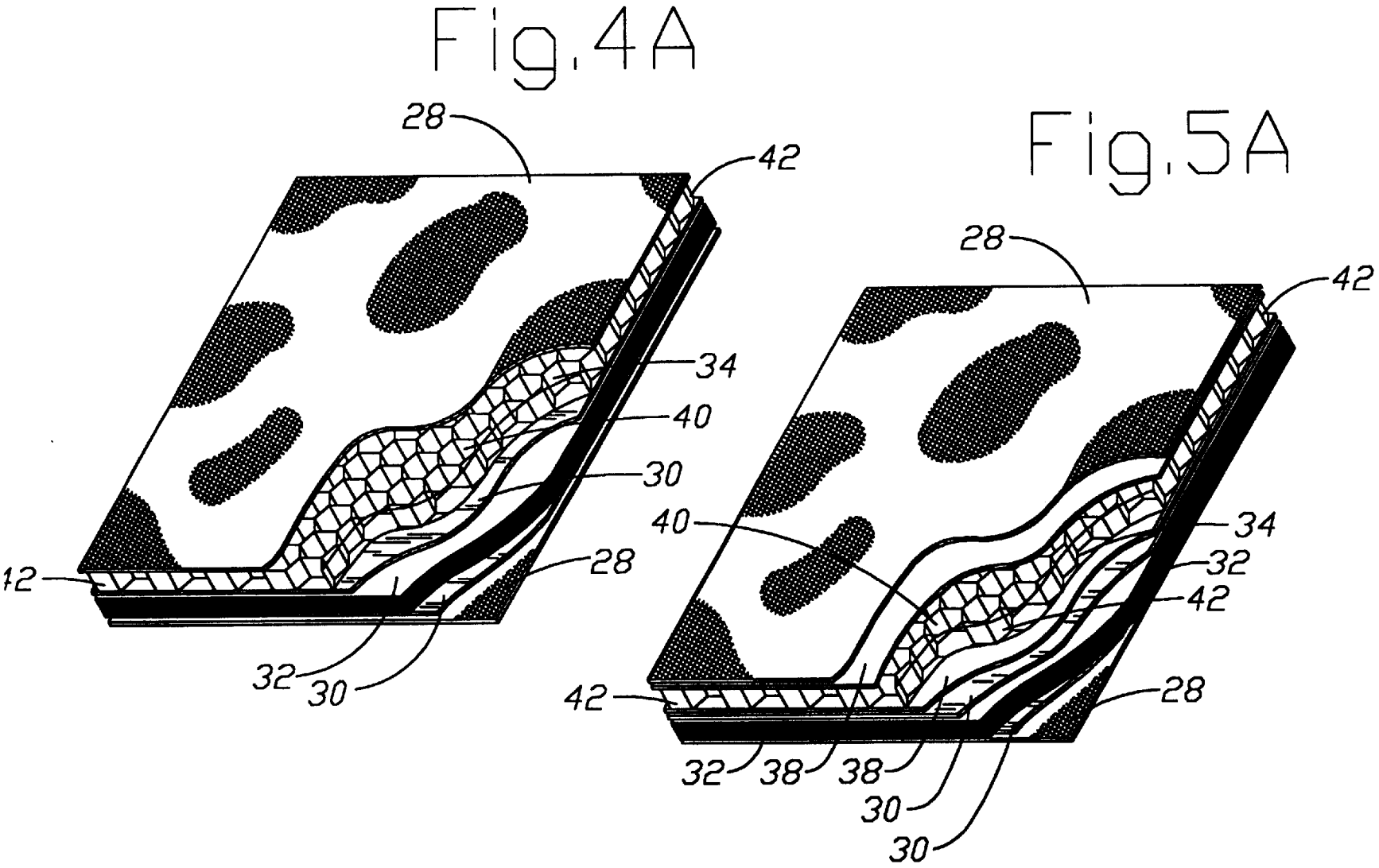
FIG. 4A is a perspective view of a portion of the panel shown in FIG. 2 partially broken away.
FIG. 5A is an alternative embodiment of the panel shown in FIG. 4A.
Figure 4B:
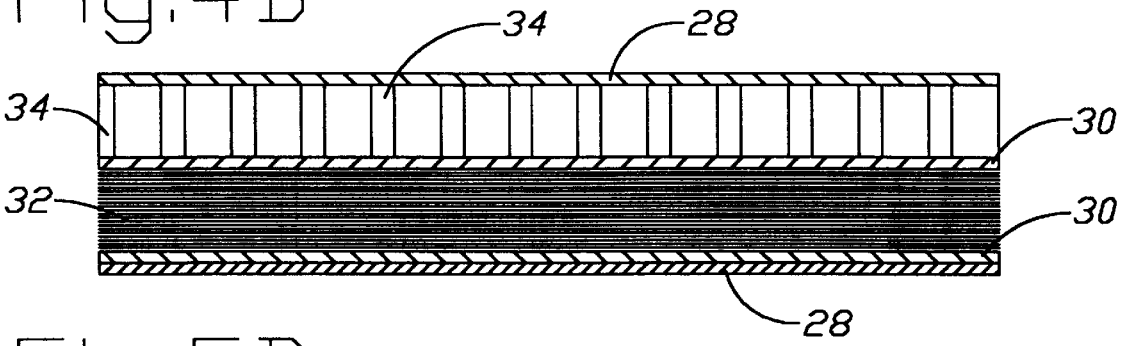
FIG. 4B is an enlarged end view of the panel shown in FIG. 4A.
Figure 5B:
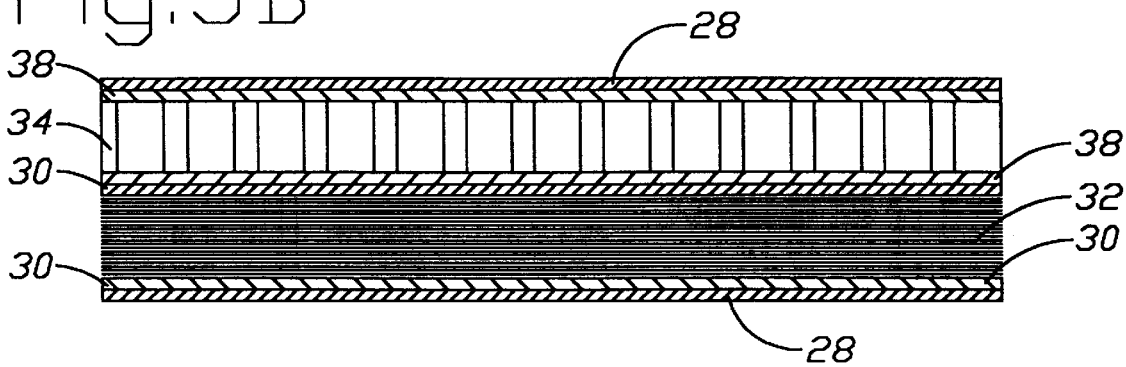
FIG. 5B is an enlarged end view of the panel shown in FIG. 5A.

With regard to the embodiment shown in FIG. 2, in which flexible sheet 34 is positioned to overlie pad cover 30, a more detailed view is shown in FIGS. 4A and 4B. The flexible sheet 34 containing the resilient honeycomb structures is positioned to face outwardly from the wearer, a strike face position, whereas layer of body armor material 34 is positioned innermost to the body of the wearer. Another embodiment of this construction is shown in FIGS. 5A and 5B. Flexible sheet 34 is positioned to overlie pad cover 30, see FIGS. 5A and 5B, and face outwardly from the wearer, a strike face position, but flexible sheet 34 of resilient honeycomb structures are sandwiched between two film sheets 38 constructed of polyurethane. The interconnected resilient honeycomb structures, preferably of hexagonal shapes, facilitate transference of energy away from a blunt object impact.

Figure 6B:
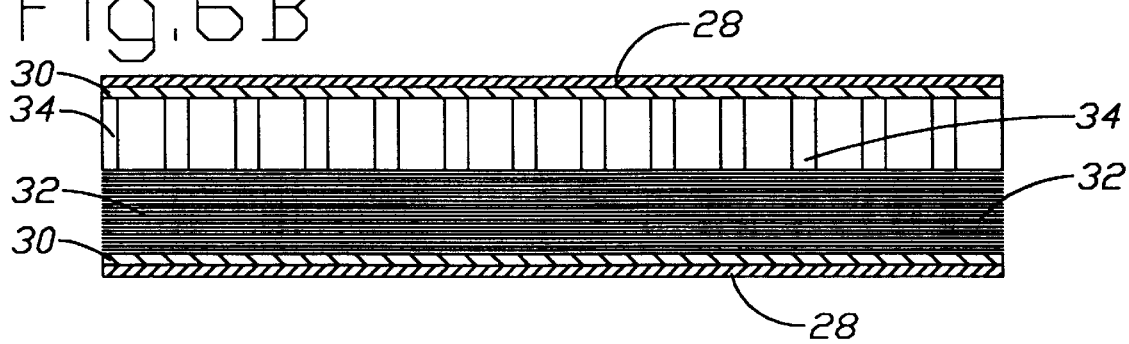
FIG. 6B is an enlarged end view of the panel shown in FIG. 6A.
Figure 7B:
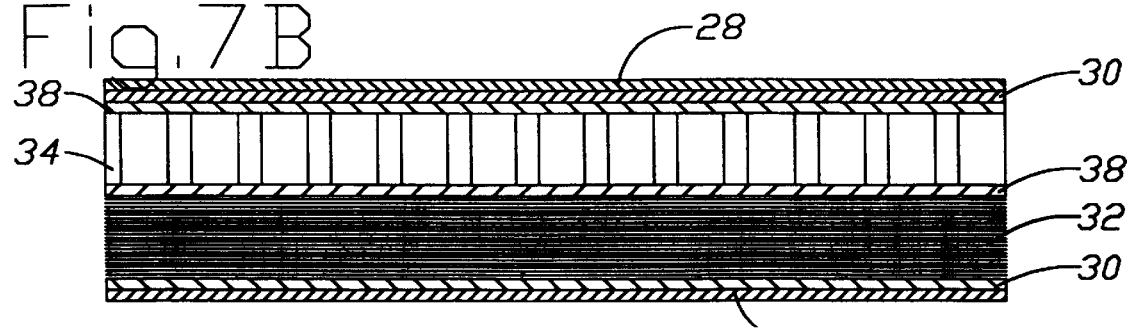
FIG. 7B is an enlarged end view of the panel shown in FIG. 7A.
Figures 6A, 7A:
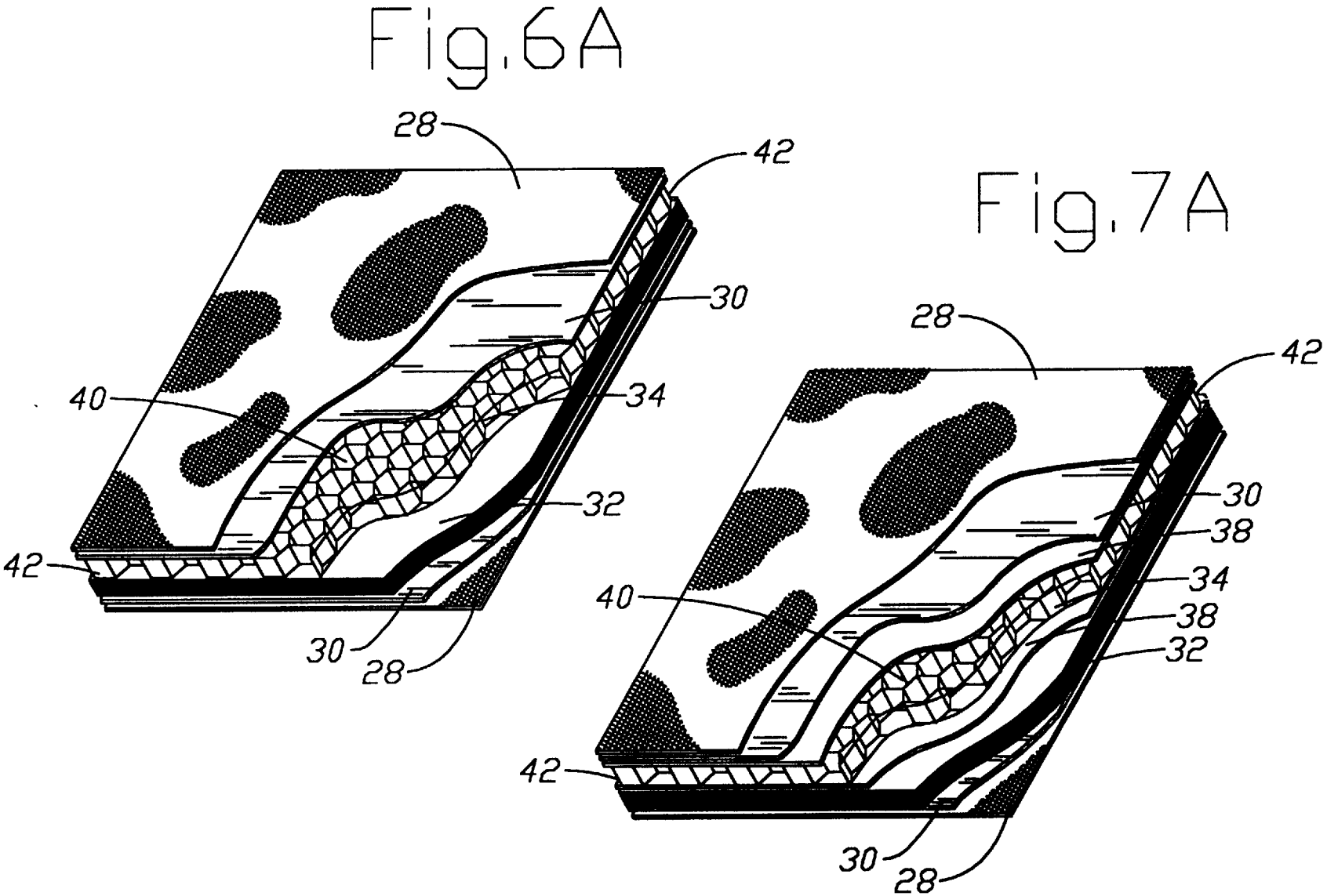
FIG. 6A is a perspective view of a portion of the panel shown in FIG. 3 partially broken away.
FIG. 7A is an alternative embodiment of the panel shown in FIG. 6A.

With regard to the embodiment shown in FIG. 3, flexible sheet 34 is positioned to overlie layer of body armor material 32 such that flexible sheet 34 is positioned between the body armor layer 32 and sidewall 36 of pad cover 30, a more detailed view is shown in FIGS. 6A and 6B. Again, as clearly shown in FIGS. 6A and 6B flexible sheet 34 containing the resilient honeycomb structures is positioned to face outwardly from the wearer, a strike face position, whereas layer of body armor material 32 is positioned innermost to the body of the wearer. Another embodiment of this construction is shown in FIGS. 7A and 7B. Flexible sheet 34, FIGS. 7A and 7B, is positioned to overlie layer of body armor material 32 and to be positioned between sidewall 36 of pad cover 30 and layer 32. In this position, flexible sheet 34 again faces outwardly from the wearer, a strike face position, but flexible sheet 34 of resilient honeycomb structures are sandwiched between two film sheets 38, FIG. 7A and 7B, constructed of polyurethane. As mentioned above, the interconnected resilient honeycomb structures, preferably of hexagonal shapes, facilitate the transference of energy away from a blunt object impact.

It has been found that placement of flexible sheet 34 of thermoplastic polyurethane honeycomb structures over body armor material 32 at a strike face position has superior performance results over arrangements having the flexible sheet inside and underlying the body armor material. For instance, blunt trauma forces received upon an underlying body are reduced when the flexible thermoplastic polyurethane sheet overlies the body armor layer as opposed to the body armor layer overlying or sandwiching the flexible sheet. Additionally, it has been found when applying the California Ice Pick Test for puncture resistance, that puncture protection is decreased when the flexible sheet of thermoplastic honeycomb structures is placed on the inside of the body armor layer. Moreover, it has been experienced that placement of the flexible sheet of honeycomb structures on the inside of the body armor layer deteriorates the ballistic capabilities of the protective armor.

As was mentioned above, the layer of body armor material 32 can take on many different constructions. Layer 32 is selectively designed to be ballistic resistant, puncture resistant or a hybrid combination of both ballistic and puncture resistant. The construction of the various designs include woven and nonwoven constructions of protective layers or sheets.

As for ballistic resistant construction of layer 32, it is contemplated that designs having varying levels of stopping capabilities be employed. These designs selectively include a plurality of woven sheets constructed of high tensile strength fibers; a layer of nonwoven material of high strength; or even a combination of woven sheets constructed of high tensile strength fibers used in conjunction with at least a layer of nonwoven material of high strength.

It is contemplated that many fiber types may be used in the present invention to construct and weave ballistic resistant sheets of the body armor layer 32. Aramid fibers or other high tensile strength fibers of preferably greater than 50 to 1500 denier may be suitably employed. Aramid fibers such as Kevlar® fibers, manufactured by E. I. Du Pont de Nemours & Co., of Wilmington, Del., are often used in the construction of ballistic resistant panels. These Kevlar® fibers are commonly known such as Nos. 29, 49, 129, 149, LT, Totera™ Kevlar®, Correctional™, etc. Other fibers used in forming ballistic resistant fabrics include Twaron® T-1000 and T-2000 made by AKZO NOBEL, Inc. and Spectra® manufactured by Allied Signal, Inc. Many types of fibers are available for this ballistic resistant construction which includes polyethylene fibers, aramid fibers, PBO fibers (poly (P-phenylene-2, 6-Benzobisoxazole)) known as ZYLON™, a trademark of Toyobo Co. Ltd., of Osaka, Japan and other comparably strong fibers and the like. Moreover, there have been generations of fibers and fabrics made from these fibers which have evolved over the years beginning with the first generation of ballistic nylon; second generation of Kevlar® 29, Kevlar® 49, Twaron and Spectra®; third generation of Twaron T-2000 Microfilament, Kevlar® 129 and Kevlar® LT fabrics; and fourth generation of Araflex™. Numerous fibers may be suitably used in the construction of woven ballistic resistant garments. Such a ballistic resistant panel can be seen in U.S. Pat. No. 5,479,659 entitled "Lightweight Ballistic Resistant Garments and Method to Produce Same" issued Jan. 2, 1996 to Bachner, Jr. and is herein incorporated by reference and is sold as the Monarch®, a registered trademark of Second Chance Body Armor, Inc. of Central Lake, Mich.

Similarly, nonwoven materials may be suitably employed to construct layer 32 of body armor material. Metallic sheet members such as titanium or other suitable very strong metal may be used. Other suitable nonwoven materials which are ballistic/and puncture resistant such as Spectra Shield®, Spectra Flex®, Gold Shield®and Gold Flex®manufactured by Allied Signal Inc. of Morris County, N.J., and ZYLON™ Shield and ZYLON™ Flex manufactured by Toyobo Co. Ltd., of Osaka, Japan, as well as, other reinforced plastics, and other nonwoven composite materials and the like may be employed in the present invention.

Combinations of ballistic resistant constructions may alternatively be used that would incorporate sheets of woven high tensile strength fibers, as well as, at least a sheet of nonwoven high strength material incorporated therewith.

Layer 32 of body armor may alternatively be constructed to resist puncture forces, for which there are known constructions, however, it would be preferable for this layer 32 to include a plurality of overlying woven sheets of high tensile strength fibers such as Kevlar® to accomplish this task. To adequately protect the body of a wearer from an attempted puncture wound, the woven sheets of the puncture resistant body armor layer 32 are formed of a sufficiently tight weave of at least sixty (60) aramid fibers per inch in one direction and at least sixty (60) aramid fibers per inch in another crossing direction that is generally transverse to the first direction of aramid fibers. The tightly woven fibers are constructed of filaments of preferably from (50,000,000) fifty million filament crossovers per square inch up to (90,000,000) ninety million filament crossovers per square inch in each of the individual woven sheets in a puncture resistant layer 32. This range of filament crossovers is generally significantly below what is utilized in ballistic resistant weaves. Lower crossover numbers are utilized in the puncture resistant body armor panel for repelling and trapping hand driven sharp objects such as knives, awls, shanks and the like mentioned above.

The woven aramid fibers, for the puncture resistant embodiment of body armor layer 32, provide greater than (3.0%) three percent of break elongation which indicates the length the material will elongate before it breaks. This greater than three percent amount for break elongation indicates the fiber employed in forming the woven sheet is capable of deforming with the imparting of energy from the impact of a sharp object facilitating slowing, inhibiting and trapping of the sharp object in preventing puncture penetration. The aramid fibers employed in the puncture resistant layer 32 provide greater than 23.8 grams per denier tenacity. This is a significantly high tenacity whereby high tenacity in combination with a high break to elongation provides the relatively increased toughness of the fiber which has been shown to be a key aspect for engaging sharp objects that are thrusted at the wearer. Preferably, the puncture resistant body armor layer 32 is between 0.08 inches and 0.25 inches in thickness. For further details on the puncture resistant layer, reference can be made to U.S. patent application Ser. No. 08/691,251 entitled "Puncture Resistant Protective Garment And Method Of Making And Testing The Same" of Bachner, Jr., filed on Aug. 2, 1996, which is incorporated herein by reference and sold as the Prism™ a trademark of Second Chance Body Armor, Co., of Central Lake Mich.

Thus, layer 32 has numerous ballistic constructions and puncture resistant constructions. Moreover, a combination of these two features can be combined to form a hybrid of ballistic and puncture resistant capabilities. Such a hybrid construction is also taught in U.S. patent application Ser. No. 08/691,251 entitled "Puncture resistant Protective Garment And Method Of Making And Testing The Same" of Bachner, Jr., filed on Aug. 2, 1996, which is incorporated herein by reference and sold as the Prism Plus P Plush™, a trademark of Second Chance Body Armor, Inc., of Central Lake, Mich.

While a detailed description of the preferred embodiments of invention has been given, it should be appreciated that many variations can be made thereto without departing from the scope of the invention as set forth in the appended claims.

I claim:

1. A protective garment of multi-component construction for covering and protecting vital portions of a body of a wearer, comprising:

a layer of body armor material formed of a plurality of layered sheets of at least one of ballistic resistant and puncture resistant material; and a flexible sheet having a plurality of resilient honeycomb cellular structures constructed of thermoplastic polyurethane placed outermost and positioned to overlie each of the sheets of the layer of body armor material and to face outwardly from the body of the wearer and in which all of the sheets of the layer of body armor material are positioned between the sheet of resilient honeycomb cellular structures and the body of the wearer upon which the protective garment is worn.

2. The protective garment of claim 1 includes a carrier for encasing said layer and said sheet.

3. The protective garment of claim 2 in which said carrier is constructed of woven cloth.

4. The protective garment of claim 1 includes a pad cover for encasing said layer.

5. The protective garment of claim 4 in which said pad cover is constructed of polyester.

6. The protective garment of claim 4 in which said pad cover is constructed of water repellant and vapor breathable material.

7. The protective garment of claim 4 in which said flexible sheet is positioned between said pad cover sleeve and said layer and in which the flexible sheet is secured against the layer.

8. The protective garment of claim 7 in which the flexible sheet is confined within and is substantially coextensive to the pad cover securing the flexible sheet against the layer.

9. The protective garment of claim 4 in which said pad cover is constructed of nylon.

10. The protective garment of claim 4 in which said pad cover is positioned between said flexible sheet and said layer.

11. The protective garment of claim 10 includes means for securing said flexible sheet to said pad cover which includes the flexible sheet being confined within a carrier which holds the pad cover and which holds said flexible sheet which is substantially coextensive to the pad cover sleeve against the pad cover securing the flexible sheet against the pad cover.

12. The protective garment of claim 1 in which said cellular structures are open hexagon shapes.

13. The protective garment of claim 12 in which the dimension across said hexagon shape is from ¼ inch to 1 inch.

14. The protective garment of claim 12 in which a sidewall of said hexagon shape has a height is from 0.070 inches to 2.000 inches.

15. The protective garment of claim 1 includes a polyurethane film disposed over one side of said flexible sheet of said cellular structures enclosing one open end of said cellular structures.

16. The protective garment of claim 15 includes a polyurethane film disposed over both sides of said flexible sheet enclosing both open ends of said cellular structures.

17. The protective garment of claim 15 in which said polyurethane film has a thickness of 0.005 inches to 0.020 inches.

18. The protective garment of claim 1 in which the layer includes a plurality of sheets of woven high tensile strength fibers.

19. The protective garment of claim 1 in which the layer includes at least one sheet of nonwoven high strength material.

20. The protective garment of claim 1 in which the layer includes a plurality of sheets of woven high tensile fibers and at least one sheet of nonwoven high strength material.

* * * * *

UNITED STATES PATENT AND TRADEMARK OFFICE

CERTIFICATE OF CORRECTION

PATENT NO : 5,918,309

DATED : July 6, 1999

INVENTOR(S) : Thomas E. Bachner, Jr.

It is certified that error appears in the above-identified patent and that said Letters Patent is hereby corrected as shown below:

Col. 7, Line 35, change "Plush ™" to --Plus™ --.

Signed and Sealed this

Tenth Day of October, 2000

*Attest:*

*Attesting Officer*

Q. TODD DICKINSON

*Director of Patents and Trademarks*